US006840505B1

(12) United States Patent
Sharp et al.

(10) Patent No.: US 6,840,505 B1
(45) Date of Patent: Jan. 11, 2005

(54) ROOF NAIL EXTRACTOR

(76) Inventors: Eugene F. Sharp, 38354 Sharp La., Ponchatoula, LA (US) 70454; John G. Wilde, 43182 Jerry Wilde Rd., Ponchatoula, LA (US) 70454

( * ) Notice: Subject to any disclaimer, the term of this patent is extended or adjusted under 35 U.S.C. 154(b) by 0 days.

(21) Appl. No.: 10/638,647

(22) Filed: Aug. 12, 2003

(51) Int. Cl.[7] ..... B66F 15/00
(52) U.S. Cl. ..... 254/27; 254/130
(58) Field of Search ..... 254/21, 25, 27, 254/120, 131, 129, 130

(56) References Cited

U.S. PATENT DOCUMENTS

| | | | |
|---|---|---|---|
| 82,568 | A | 9/1868 | Tyzick et al. |
| 1,317,156 | A | 9/1919 | Diamond |
| 3,643,918 | A | 2/1972 | Ellis |
| 3,704,860 | A | 12/1972 | Krapu |
| 4,815,707 | A | 3/1989 | Brown |
| 5,213,311 | A | 5/1993 | Sabo |
| 6,015,136 | A | 1/2000 | Benudiz |
| 6,105,935 | A | 8/2000 | Wagner |
| 6,443,428 | B1 | 9/2002 | Santibanez et al. |

FOREIGN PATENT DOCUMENTS

| | | |
|---|---|---|
| DE | 3108097 | 9/1982 |

*Primary Examiner*—Robert C. Watson
(74) *Attorney, Agent, or Firm*—Richard C. Litman

(57) ABSTRACT

The roof nail extractor is a device for removing fasteners that are embedded in the surface of roof materials. The extractor has a base that is positioned flat on the top of a roof surface. The base includes mounting projections that extend upwardly from the top of the base. Each of the projections has a plurality of through holes adapted to receive a pivot bar that extends through the through holes. A hinge is mounted along the pivot bar, which pivotally mounts the lever to the base. The lever is an elongate rod having a handle coupled to its top end and a fastener engaging head disposed on its bottom end. The head is adapted to grip the top of an embedded fastener. Once the head grips a fastener the lever is pushed downward. The head is then raised and removes the embedded fastener.

19 Claims, 7 Drawing Sheets

ROOF NAIL EXTRACTOR

BACKGROUND OF THE INVENTION

1. Field of the Invention

The present invention relates to roofing devices, and more particularly to a nail removal tool for removing an elongated object from a body in which it is embedded.

2. Description of the Related Art

The conventional way to remove nails from roof tiles has been to secure the head of the nail with a hammer and then beat the handle of the hammer with a second hammer until the nail has been pulled out of the roof tile. This method of removing nails has many drawbacks. Beating the two hammers together in this fashion often results in injury to the user because pieces often flake off both of the hammers and may contact the user's eyes or skin. Also, by beating the two hammers together the tools are often rendered useless because the handles become warped. Finally, the roof materials are also destroyed when pulling the nails by this method. Another problem is that it is often difficult to engage the head of the nail because of uneven portions of the roof. Several nail extracting devices have been developed in an attempt to solve the aforementioned problems. The following patent documents disclose examples of these nail extractor devices.

German Patent Number 3,108,097 published on Sep. 23, 1982, discloses pincers for removing roofing nails. The pincers comprise two pincer jaws equipped with lever handles and linked to one another crosswise by means of a joint pin. A supporting element extending away from the pincer jaws is arranged on one of these lever handles. The supporting element has a cylinder-jacket-shaped rolling surface running parallel to the axis of the joint pin. The pincers, after taking hold of the nail and after subsequent pivoting of the lever handles, roll on the rolling surface and pull out the nail in the course of the rolling.

U.S. Pat. No. 6,443,428 issued on Sep. 3, 2002 to Santibanez et al. discloses a nail removing apparatus. The apparatus comprises a housing having bottom, top and sidewalls. A foot portion having a pair of tines adapted for gripping the head of a nail is disposed along the bottom wall of the housing. Once the tines grip the nail head a lifting apparatus lifts the nail.

U.S. Pat. No. 6,105,935 issued on Aug. 22, 2000 to Wagner discloses a nail removal tool. The tool comprises an elongated shaft portion having a handle portion at its upper end and a pivot mechanism at its lower end. A movable head portion is connected to the pivot mechanism. The head portion has a first jaw member fixed to it and a jaw bedway. A second jaw member is attached to a moveable jaw bedway parallel to the first jaw member. The jaw members grip the nail and the lever pulls the nail out from the surface.

U.S. Pat. No. 6,015,136 issued on Jan. 18, 2000, discloses a portable fastener remover apparatus. The apparatus has a housing that may be placed on the surface containing the embedded fastener. The apparatus further comprises a force transfer member that is moveably secured to the housing. The force transfer member has an engagement portion for releasably engaging the embedded fastener. The apparatus also has a jack for lifting the force transfer member once it has engaged an embedded fastener.

U.S. Pat. No. 5,213,311 issued on May 25, 1993 to Sabo, discloses a nail extractor. The extractor includes a gripping member having a plurality of gripping prongs. A lever is releasably secured to a top end of the gripping member. The gripping member grips a nail embedded in a piece of wood. Once the nail is gripped a force is applied to the lever to lift the nail out of the wood.

U.S. Pat. No. 4,815,707 issued on Mar. 28, 1989 to Brown, discloses a nail puller. The nail puller has an elongate body having a gripping jaw and a handle socket for receiving a handle. A movable jaw is pivotally attached to the puller body and defines a jaw blade and an extending lever arm. The gripping jaw grips the head of nail and the handle pivots to remove the nail from the material it is embedded in.

U.S. Pat. No. 3,704,860 issued on Dec. 5, 1972 to Krapu, discloses a wedging and prying tool. The tool comprises a U-shaped jaw disposed along its base for gripping an item to be lifted. The jaw is secured to a carriage that is moved by a rack and pinion assembly.

U.S. Pat. No. 3,643,918 issued on Feb. 22, 1972 to Ellis, discloses a nail extracting device. The device comprises a pneumatic impact member for drivingly engaging a pair of pivotally mounted jaws that are adapted to grip the head of a nail.

U.S. Pat. No. 1,317,156 on Sep. 30, 1919 to Diamond, discloses a nail puller. The nail puller comprises a plurality of plates having flared ends and nail receiving slots extending through the center of the plates. The top plate is angled so that the back end of the plate is positioned higher than the front end of the plate. The flared ends of the two plates engage the head portion of the embedded nails. Once engaged, the nail puller is pushed forward and slides along the surface that the nails are embedded in. As the nail puller is pushed forward the nail slides through the slots in the plates. As the nail slides through the slots it is lifted to continue sliding through the inclined upper plate, which removes the nail from the material it is embedded in.

U.S. Pat. No. 82,568 issued on Sep. 29, 1868 to Tyzick et al. discloses a nail extractor. The nail extractor comprises a handle portion with a gripping head disposed on a bottom end of the handle portion. The gripping head has a slot for engaging an embedded nail. Once the nail is engaged in the slot the handle is pivoted backward to lift the nail.

None of the devices disclosed above provide a nail extractor that can easily remove nails when they are embedded in a roof that have uneven surfaces. Certain roofs have crimped segments where sharp inclined peaks form. Other roofs may have metal ribs that extend upward from the roof surface. In either case the above devices will not be able to properly grip the head of a nail if it is positioned adjacent a crimp or rib. a nail extractor that may be adapted to any uneven surface on a roof to allow nails to be easily removed is desirable.

None of the above inventions and patents, taken either singly or in combination, is seen to describe the instant invention as claimed. Thus a roof nail extractor solving the aforementioned-problems is desired.

SUMMARY OF THE INVENTION

The roof nail extractor is a device for removing fasteners that are embedded in the surface of a material. The roof nail extractor is particularly designed for removing nails that are embedded in roofing materials, but it may be used to remove almost any embedded fastener. The extractor includes a base, a lever, a pivot bar, a hinge, a handle, and a fastener engaging head. The extractor may also include a support frame, which is optionally used in situations where the surface containing the embedded fasteners is uneven or has areas of elevated height.

The base has a flat, generally U-shaped main body with a front portion and a pair of side portions that extend outward from the front portion. A pair of mounting projections are disposed along the side portions of the base. The mounting projections are vertically oriented and extend upwardly from the main body. A plurality of through holes are disposed along the mounting projections. Each set of the through holes are disposed at varying heights on the mounting projections. The base further includes a plurality of bolt receiving holes disposed along its main body. A plurality of securing nuts are welded to the outside surface of the mounting projections. Each of the securing nuts is aligned with one of the through holes.

The pivot bar is disposed across the base and is parallel to the front portion of the base. The pivot bar is a generally cylindrical, elongate rod having a threaded end and a securing nut disposed on its opposite end. The threaded end of the pivot bar extends through the through holes of the mounting projections and engages the securing nut that is welded to the side of the mounting projection. The securing nut releasably secures the pivot bar to the base. The height of the pivot bar on the base may be adjusted by extending the pivot bar through different sets of through holes.

The lever is a generally cylindrical, elongate rod having a top end and a bottom end. A handle is coupled to the top end of the lever such that any force applied to the handle is coupled directly to the lever. A fastener engaging head is mounted to the bottom end of the lever. The fastener engaging head comprises a slot disposed through its center defining a pair of gripping fingers. The gripping fingers are adapted to engage the top portion of an embedded fastener so that the fastener becomes releasably secured in the slot.

The hinge is disposed along the pivot bar. The hinge comprises a vertically oriented pipe and a horizontally pipe oriented pipe. The vertically oriented pipe is perpendicularly oriented to the top of the horizontally oriented pipe. The pipes have hollow, generally cylindrical bodies with center through holes. The pivot bar extends through the center through hole of the horizontally oriented pipe so that the hinge is disposed along the pivot bar and is positioned parallel to the front portion of the base. The lever is pivotally mounted to the base by extending through the center through hole of the vertically oriented pipe. The hinge also includes a tightening mechanism that is disposed along the vertically oriented pipe.

The support frame is optionally disposed underneath the base for raising the nail extractor above uneven areas of the roof. The support frame has a pair of elongate support rails and each support rail has a flat top surface. A pair of elongate lifters is disposed along the underside of each of the support rails. A plurality of bolts is disposed along the flat top surface of the support rails. The bolts extend through the bolt receiving holes of the base to secure the base to the support frame.

The base, or the support frame if it is being used, is positioned on the surface containing the embedded fasteners. The fastener engaging head then grips the top portion of a fastener. Once the fastener is engaged the lever is pushed downward and pivots about the pivot bar. This causes the fastener engaging head to raise and remove the embedded fastener.

It is an object of the invention to provide a device for easily removing embedded nails from roof materials.

It is another object of the invention to provide a device for removing embedded nails that may conveniently slide across a roof to easily position the device over each of the embedded nails.

It is a further object of the invention to provide a device for removing embedded nails that has a lifting frame for adjusting the height of the device to accommodate for uneven roof surfaces.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
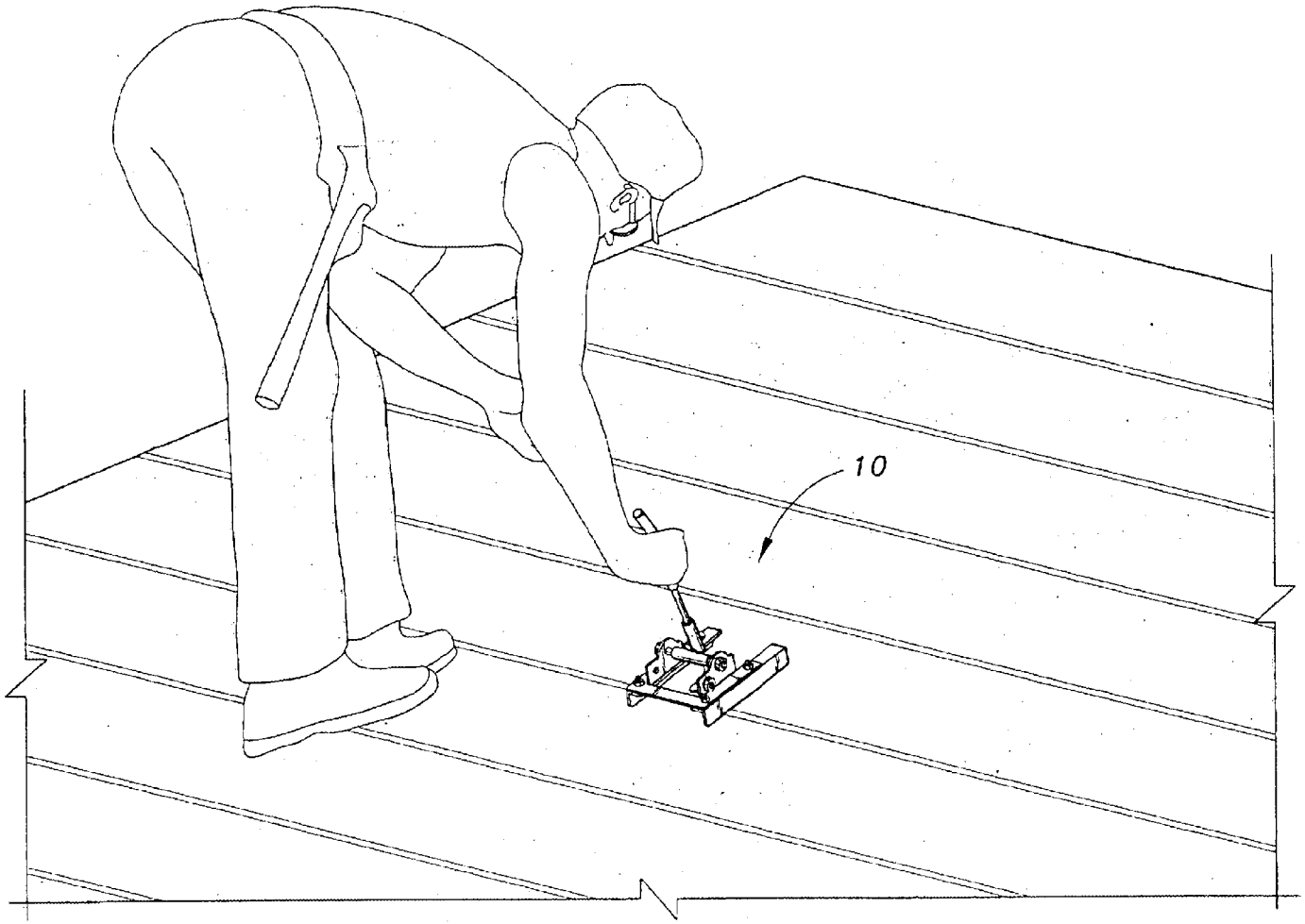
FIG. 1 is an environmental, perspective view of a roof nail extractor according to the present invention.
Figure 2:
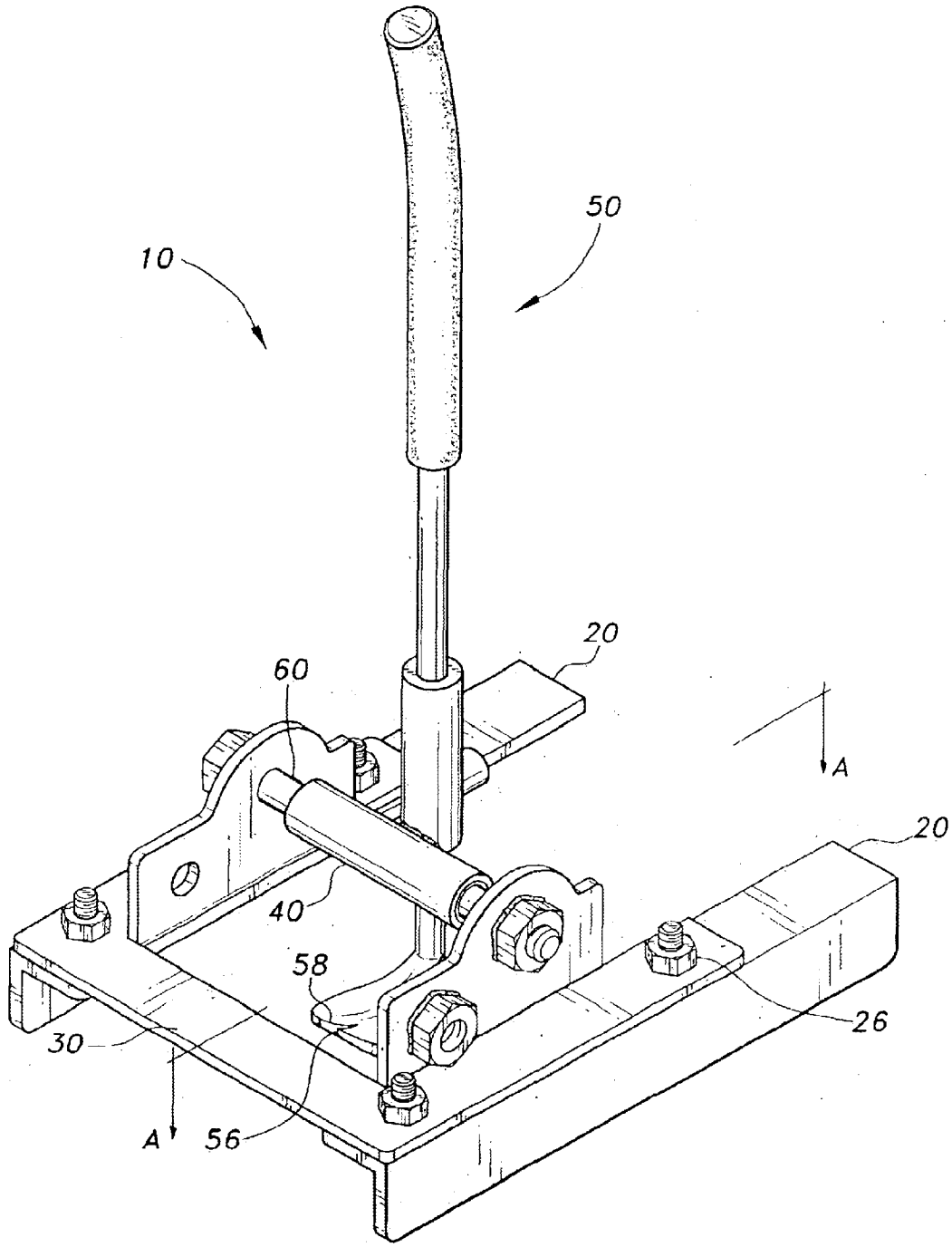
FIG. 2 is a top perspective view of the roof nail extractor.

The present invention is a roof nail extractor for extracting nails that are embedded into the surface of roof materials. The roof nail extractor may rest flush on any roof surface to easily remove embedded nails. FIG. 1 is an environmental, perspective view of the roof nail extractor 10 being used to remove an embedded nail from a roof. FIG. 2 is a perspective view of the roof nail extractor 10. The extractor 10 generally comprises a lever 50, a hinge 40, a pivot bar 60, a base 30 and a support frame 20.

Figure 4:
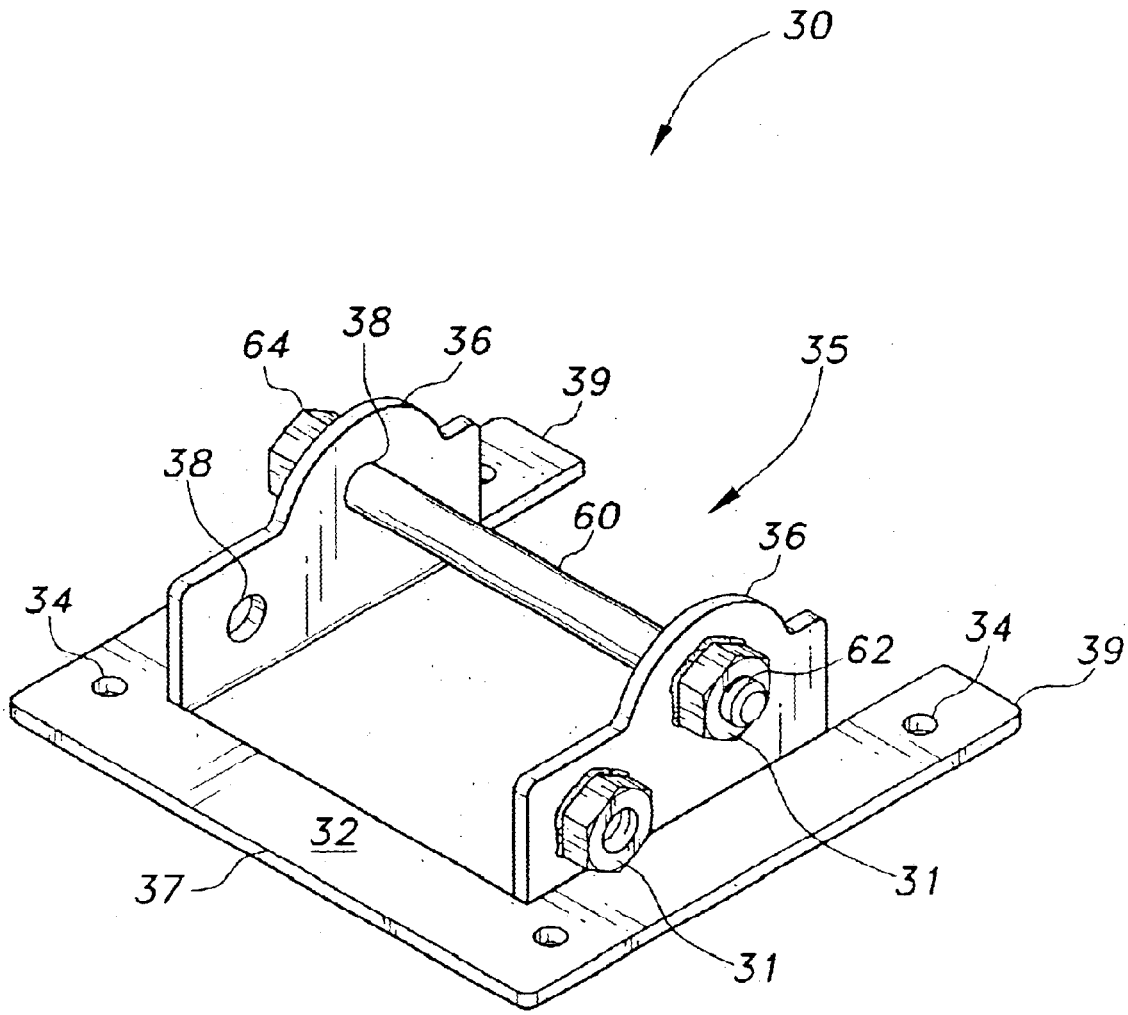
FIG. 4 is a top perspective view of the base of the roof nail extractor.

FIG. 4 is a perspective view depicting the base 30 of the extractor 10. The base 30 comprises a generally flat, U-shaped main body 32. The main body 32 has a front portion 37 and two side portions 39 extending from the front portion 37 to form an open back portion 35. The base 30 also has a plurality of bolt receiving holes 34 disposed along the main body 32. Two mounting projections 36 are vertically disposed on the main body 32. Each of the mounting projections 36 are positioned on each side 39 of the base 30 and extend vertically upward from the main body 32.

Each of the mounting projections 36 comprises a plurality of through holes 38. The through holes 38 are adapted to receive the pivoting bar 60. The pivoting bar 60 is a generally cylindrical elongated rod having a threaded end 62 and a nut head 64 at its opposite end. The thread end 62 of the bar 60 extends through the through holes 38 on each of the mounting projection 36. Once the threaded end 62 extends out past the second mounting projection 36 it is engaged by a fastener. The fastener 31, which is preferably a standard fastening nut, secures the pivoting bar 60 in place across the base 30. Multiple sets of through holes 38 are provided so that the height of the pivoting bar 60 may be adjusted. The fasteners 31 are welded onto the mounting projections 38 so that the pivoting bar 60 will automatically engage the fasteners 31 when it passes through the through holes 38.

Figure 6:
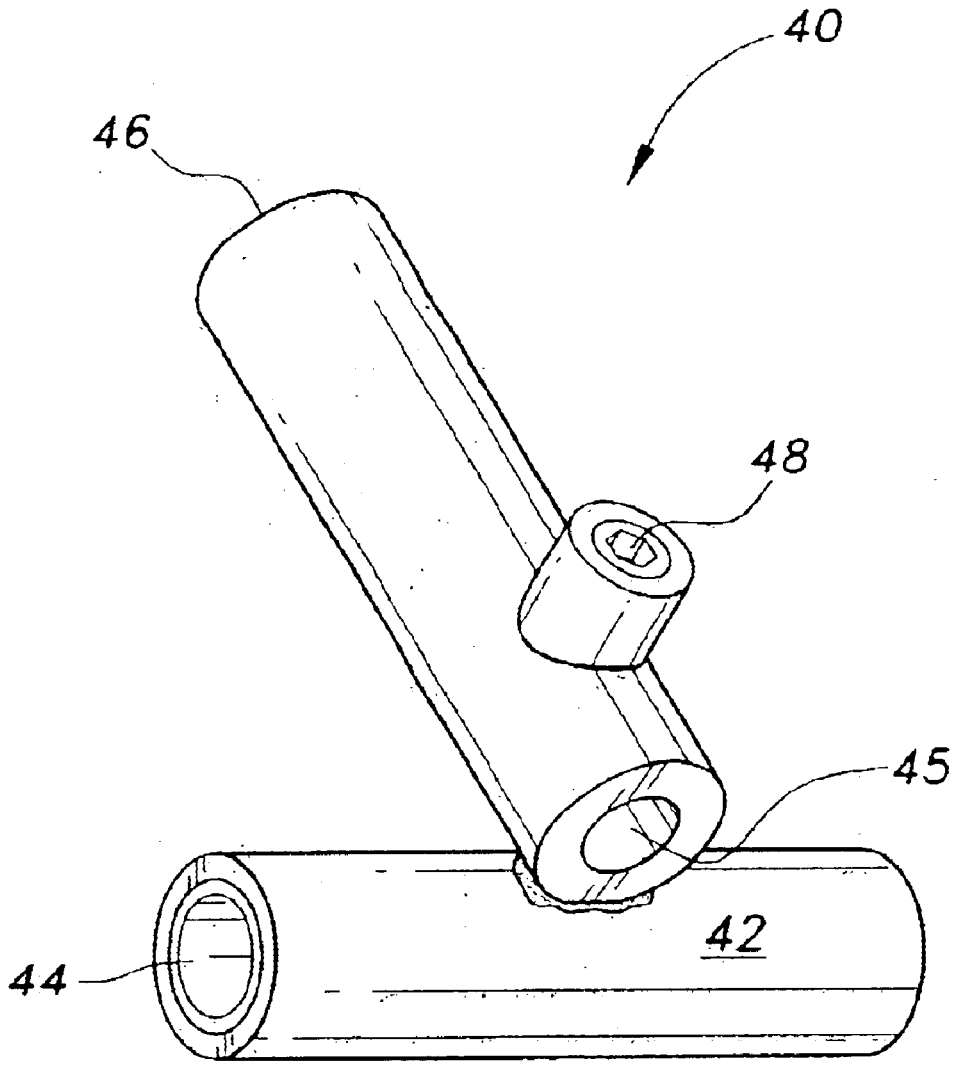
FIG. 6 is a perspective view of the hinge of the roof nail extractor.

FIG. 6 is a perspective view of the hinge 40. The hinge comprises a pair of perpendicularly oriented pipes 42, 46. A first pipe 42 is oriented horizontally across the base 30 and parallel to the front 37 of the base 30 (as shown in FIG. 2). The second pipe 46 is vertically oriented and extends away from the horizontal pipe 42 parallel to the side portions 39 of the base 30 (as shown in FIG. 2). The horizontal pipe 42 and the vertical pipe 46 each have hollow, generally cylindrical bodies with through holes 44, 45 respectively. The vertical pipe 46 is welded onto the top of the horizontal pipe 42.

The vertical pipe 46 is adapted to receive the lever 50. The lever 50 extends through the through hole 46. The hinge 40 further comprises a tightening mechanism 48 for securing the lever inside of the pipe 46. The tightening mechanism 48 is preferably an Allen screw, but any appropriate fastener may be used. The horizontal pipe 42 is adapted to secure the hinge 40 to the pivoting bar 60. The pivoting bar 60 extends through the through hole 44 and positions the hinge 40 between the mounting projections 36 of the base 30.

Figure 5:
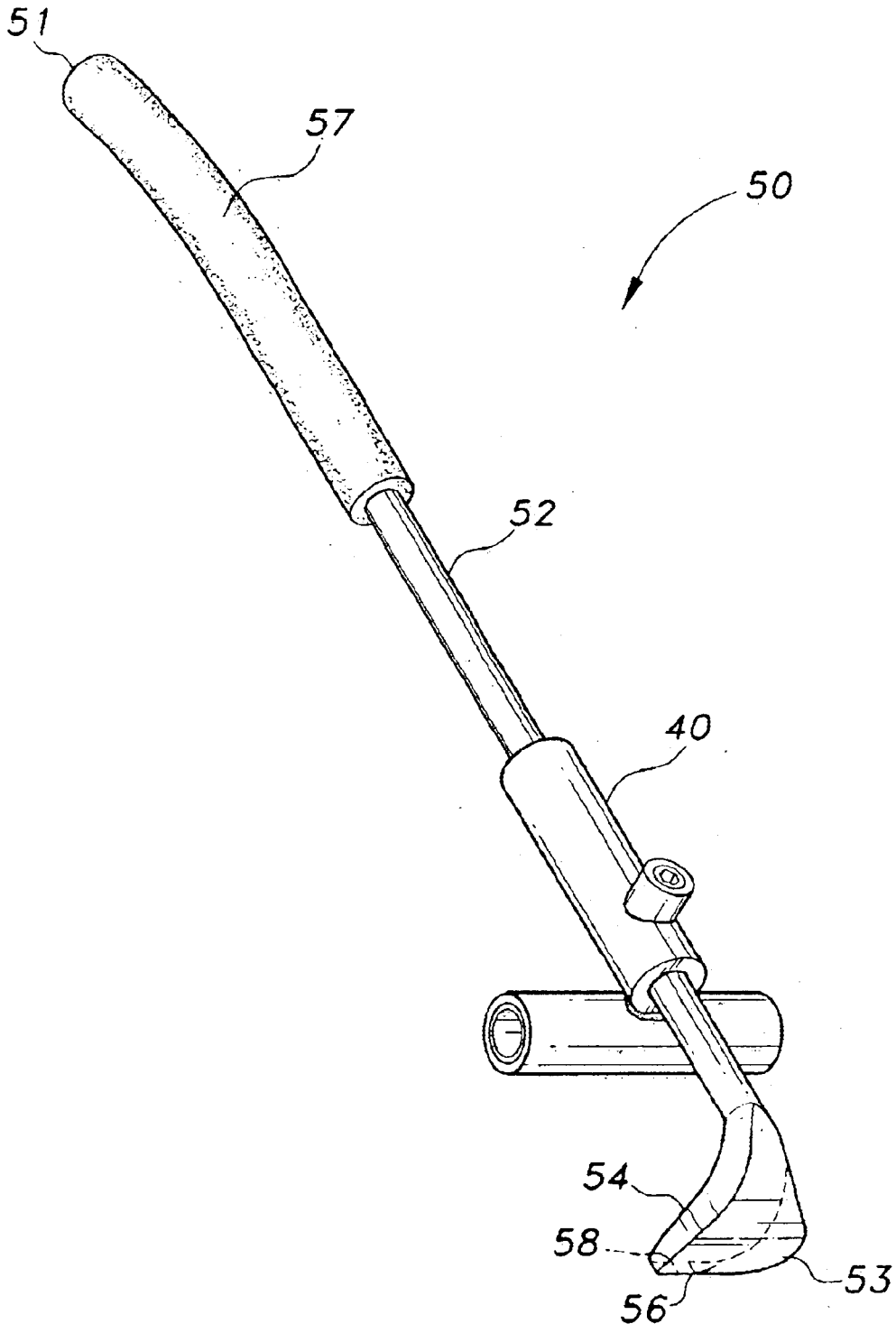
FIG. 5 is a perspective view of the lever of the roof nail extractor.

FIG. 5 is a perspective view depicting the lever 50. The lever comprises a generally cylindrical, elongate body 52 having a top end 51 and a bottom end 53. The lever 50 is depicted attached to the hinge 40. A generally cylindrical, elongate handle 57 is secured to the top end 51 of the lever 50. The center axis of the handle 57 is generally aligned with the center axis of the lever body 52. The handle 57 is coupled to the body 52 securely so that lateral forces applied to the handle 57 are coupled directly to the lever 50.

A fastener engaging head 54 is secured to the bottom 53 of the lever 50. The fastener engaging head 54 has a slot 56 formed in the front center of the head 54. The slot defines two adjacent gripping fingers 58 that releasably engage the top of an embedded fastener. The fastener engaging head 54 is mainly used to engage nails that are embedded in roof materials, but the fastener engaging head 54 can also grip other fasteners as well.

Figure 3:
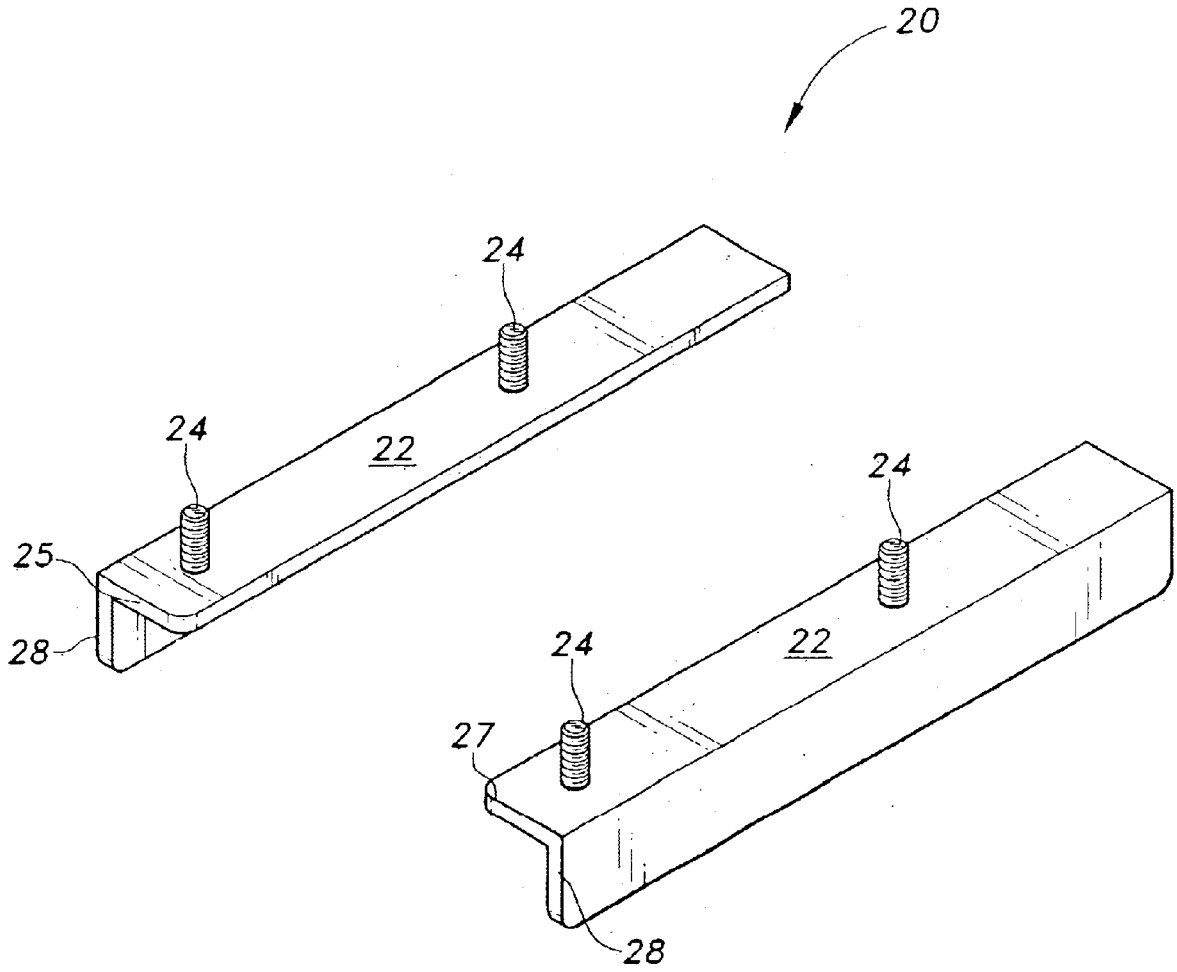
FIG. 3 is a top perspective view of the support frame of the roof nail extractor.

FIG. 3 is a perspective view of the support frame 20. The support frame 20 comprises a pair of elongate support rails 25,27 having flat top surfaces 22. The support rails 25,27 are each positioned underneath one of the side portions 39 of the base 30. The support frame 20 further comprises a pair of vertically oriented, elongate lifters 28 that are disposed along the underside of each support rail 25,27. A plurality of bolts 24 are disposed along the flat top portions 22 of each support rail 25,27. The bolts 24 are adapted to secure the frame 20 to the base 30 by extending through bolt receiving holes 34 disposed along the base 30. Once the bolts 24 extend through the holes 34 they are engaged by fasteners 26, such as wing nuts, to secure the base 30 to the support frame 20 (As shown in FIG. 2).

Different roofs have different top surfaces. Roofs surfaces may be flat or they may have ridges or areas with uneven portions. Commonly roofs are corrugated having slight ridges in their surface. Some roofs are also crimped with inclined portions forming sharp peaks. Finally, some roofs have raised metal ribs along their surfaces. In situations were the roof is flat or corrugated there is no need to attach the base 30 to the support frame 20. The base 30 can be placed flush on the surface of the roof. When the roof is crimped or has metal ribs it is necessary to use the support frame 20 to raise the base 30 above the elevated portions of the roof surface. The vertically oriented lifters 28 raise the base 30 above the elevated portions so that the extractor will rest flat on the roof. The support frame feature allows fasteners that are embedded adjacent to uneven portions of a roof to be easily removed.

Referring to FIG. 2, the roof nail extractor 10 is shown with all of its parts assembled. The base 30 is secured to the support frame 20. The lever 50 is secured to the hinge 40, which is attached along the pivot rod 60. The pivot rod 60 is secured to the mounting projections 36 of the base 30.

Figure 7:
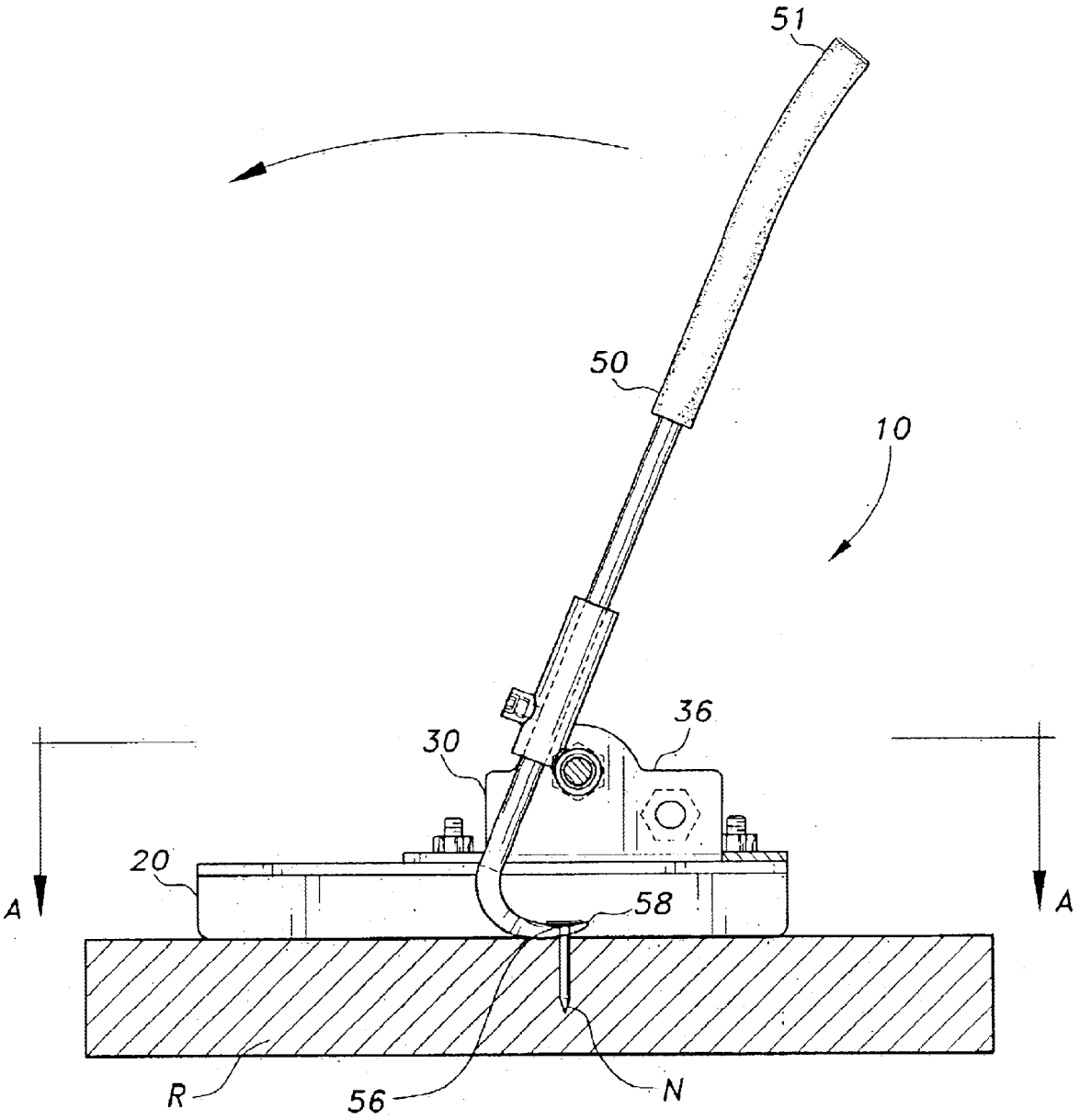
FIG. 7 is a side cross sectional view of the roof nail extractor.

FIG. 7 is a cross-sectional view of the nail extractor 10 showing how the extractor 10 functions. FIG. 7 shows a nail N embedded in a roof R. The support frame 20 is placed flush against the top surface of the roof R. The gripping fingers 58 of the fastener engaging head 54 secure the head of the nail N in the slot 56. Once the nail N is engaged the user of the extractor 10 applies a force, in the direction of the arrow in FIG. 7, onto the handle 57. Because the handle 57 is coupled to the lever 50, the lever is forced down and to the rear of the extractor, along the path of the arrow in FIG. 7. The lever 50 pivots about the pivoting bar. As the lever 50 is forced down the fastener engaging head 54 raises. As the head 54 raises it lifts the embedded nail N out of the roof.

It is to be understood that the present invention is not limited to the embodiment described above, but encompasses any and all embodiments within the scope of the following claims.

We claim:

1. A fastener extractor, comprising:

a base having a flat, generally U-shaped main body with a front portion and a pair of side portions extending outward from the front portion, and a pair of mounting projections disposed along each of the side portions, said mounting projections having a plurality of through-holes defined therein;

a generally cylindrical, elongate lever having a top end and a bottom end;

a pivot bar disposed across said base and extending through the through-holes on each of said mounting projections;

a hinge disposed along said pivot bar, said lever being pivotally attached to said base by said hinge;

a handle coupled to the top end of said lever such that any lateral force applied to the handle is coupled directly to said lever; and a fastener engaging head disposed on the bottom end of said lever;

wherein the fastener engaging head is adapted for gripping the top portion of an embedded fastener so that when a force is applied to the handle, said lever raises the fastener engaging head and removes the embedded fastener.

2. The fastener extractor according to claim 1, wherein said base has a plurality of bolt receiving holes defined therein extending along the main body of said base.

3. The fastener extractor according to claim 1, wherein said base further comprises a plurality of securing nuts disposed along an outside surface of one of said mounting projections.

4. The fastener extractor according to claim 1, wherein said pivot bar is a generally cylindrical, elongate rod having a threaded end and a securing nut disposed on its opposite end.

5. The fastener extractor according to claim 4, wherein the threaded end of said pivot bar extends through the through-holes of said mounting projections and engages the securing nut in order to releasably secure said pivot bar to said base.

6. The fastener extractor according to claim 1, wherein the through-holes further comprise a plurality of sets of through-holes, each set of through-holes being positioned at a different height in order to adjust the height of said pivot bar along said base.

7. The fastener extractor according to claim 3, wherein said securing nuts are welded to the outside surface of said mounting projection.

8. The fastener extractor according to claim 1, wherein said hinge further comprises a pair of perpendicularly oriented pipes.

9. The fastener extractor according to claim 8, wherein said pair of perpendicularly oriented pipes comprises a horizontally oriented pipe and a vertically oriented pipe, the vertically oriented pipe being welded to the horizontally oriented pipe.

10. The fastener extractor according to claim 9, wherein said pair of perpendicularly oriented pipes each comprise a hollow, generally cylindrical body having a center through-hole defined therein.

11. The fastener extractor according to claim 10, wherein said horizontally oriented pipe is disposed parallel to the front portion of said base along said pivot bar, said pivot bar extending through the center through-hole of said horizontally oriented pipe.

12. The fastener extractor according to claim 10, wherein said lever is pivotally mounted to said base, said lever extending through the center through-hole of said vertically oriented pipe.

13. The fastener extractor according to claim 9, wherein said hinge further comprises a tightening mechanism disposed along said vertically oriented pipe.

14. The fastener extractor according to claim 13, wherein said tightening mechanism is an Allen head screw.

15. The fastener extractor according to claim 1, wherein said fastener engaging head has a slot disposed through its center defining a pair of gripping fingers for releasably engaging the top portion of an embedded fastener.

16. The fastener extractor according to claim 1, further comprising a support frame disposed underneath said base for raising said fastener extractor above areas of a roof having uneven surfaces.

17. The fastener extractor according to claim 16, wherein said support frame comprises a pair of elongate support rails having flat top surfaces and a pair of elongate lifters disposed along the underside of the support rails.

18. The fastener extractor according to claim 17, wherein said support frame further comprises a plurality of bolts disposed along the top surfaces of said support rails, said bolts extending through the bolt receiving holes of said base in order to secure said support frame to said base.

19. A fastener extractor, comprising:

a base having a flat, generally U-shaped main body with a front portion and a pair of side portions extending outward from the front portion, and a pair of mounting projections disposed along each of the side portions, said mounting projections having a plurality of through holes disposed thereon;

a generally cylindrical, elongate lever having a top end and a bottom end;

a pivot bar disposed across said base through the through holes on each of said mounting projections;

a hinge disposed along said pivot bar;

a handle coupled to the top end of said lever such that any lateral force applied to the handle is coupled directly to said lever;

a fastener engaging head disposed on the bottom end of said lever; and a support frame disposed underneath said base for raising said fastener extractor above areas of the roof having uneven surfaces;

whereby said lever is pivotally mounted to said base by said hinge;

whereby the fastener engaging head grips the top portion of an embedded fastener and a force is applied to the handle which lowers said lever which in turn raises said fastener engaging head and removes the embedded fastener.

* * * * *